United States Patent [19]

Roodner

[11] 4,246,657

[45] Jan. 27, 1981

[54] GARMENT

[76] Inventor: Sylvia Roodner, 1385 York Ave., New York, N.Y. 10021

[21] Appl. No.: 39,782

[22] Filed: May 17, 1979

[51] Int. Cl.[3] ..... A41D 1/22

[52] U.S. Cl. ..... 2/71; 2/74; 2/212

[58] Field of Search ..... 2/69.5, 69, 71, 72, 2/73, 74, 407, 212, 213, 79

[56] References Cited

U.S. PATENT DOCUMENTS

| | | | |
|---|---|---|---|
| 1,106,663 | 8/1914 | Mayer | 2/407 |
| 1,198,762 | 9/1916 | Posner | 2/407 X |
| 1,993,568 | 3/1935 | Rosenberg | 2/71 |
| 2,419,513 | 4/1947 | Wahlberg | 2/71 |
| 2,611,132 | 9/1952 | Moeller | 2/79 |
| 2,628,359 | 2/1953 | Shalda | 2/71 |
| 3,571,810 | 3/1971 | Swett | 2/69 |
| 3,852,824 | 12/1974 | Grey | 2/79 |

*Primary Examiner*—H. Hampton Hunter
*Attorney, Agent, or Firm*—Kirschstein, Kirschstein, Ottinger & Cobrin

[57] ABSTRACT

A dress garment for dressing a person over the torso and down the legs. The garment is fashioned simply from a rectangular length cut from a single bolt of cloth, i.e. the garment basically is composed of an elongated fabric panel having side edges and end edges, with a retroverted portion between its opposite end edges. This retroverted portion is adapted to be disposed below and spaced from the crotch. The front and back of the garment are thus typically one piece except for styling, i.e. like a bag. The garment features lower lateral leg openings made by terminating the lateral stitching of the side edges of the front segment of the panel to the side edges of the rear segment above the retroverted portion, to provide lateral openings extending upwardly from the retroverted portion of the panel. The upper end edge of the front segment of the panel is adapted to be disposed in the region of the waist or upper portion of the person's torso, and the upper end edge of the rear segment of the panel is adapted to be disposed on the back of the person's torso in the region of the waist or betwen the waist and the upper portion of the person.

6 Claims, 5 Drawing Figures

FIG. 3
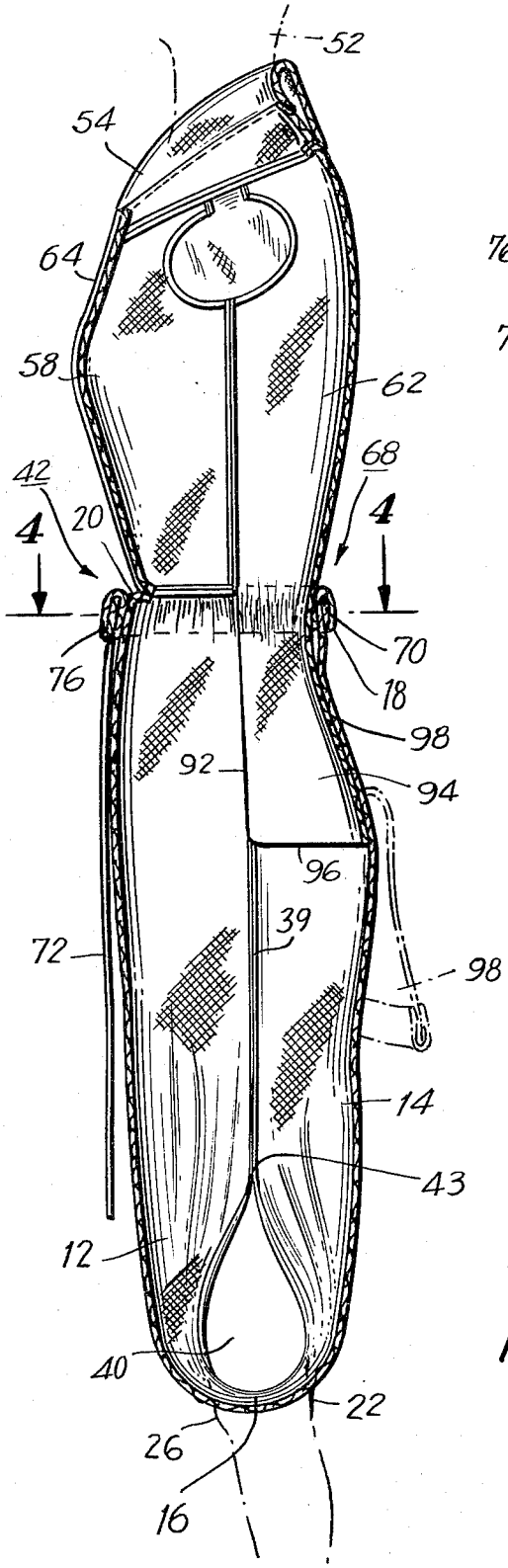
FIG. 4
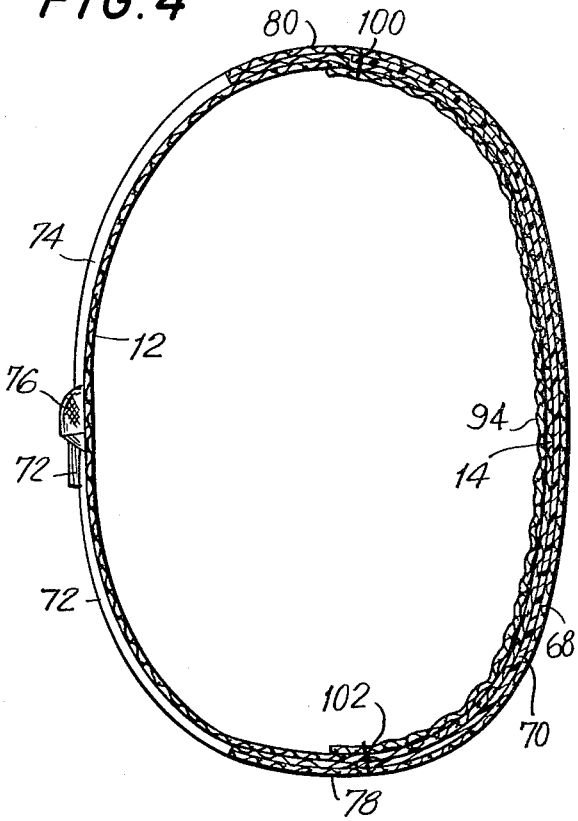
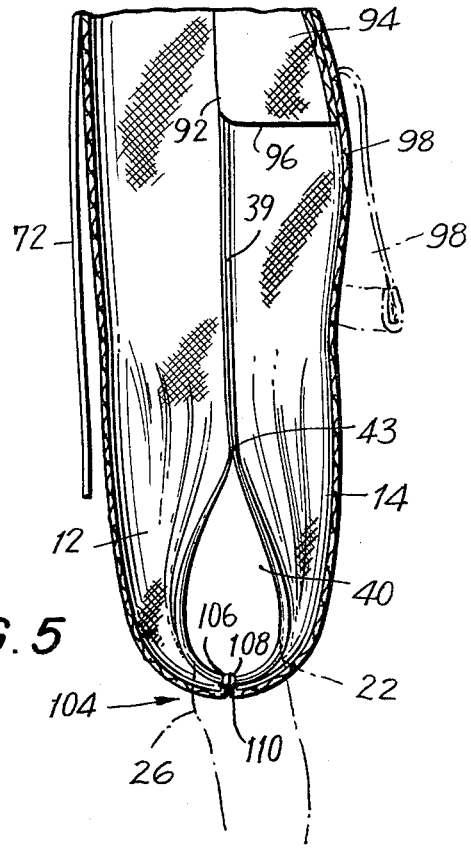
FIG. 5

GARMENT

BACKGROUND OF THE INVENTION

1. Field of the Invention

A garment for dressing a person.

2. Description of the Prior Art

Garments for covering the human body for the sake of appearance as well as for protection and warmth have been known in the earliest civilizations. Originally, garments were fabricated from the skins, pelts or hides of animals, especially furbearing animals. With the advent of advanced civilizations, garments of a more complex nature and design were developed, formed by sewing together pieces of cloth cut in patterns and shapes to conform to the shape of the human body. In most instances of current technology, a garment such as a dress, shirt, pants or coat is fabricated in mass-production facilities such as factories by sewing together interchangeable parts of the garment. Much cloth is lost in cutting out these parts, based on a pattern, from an individual rectilinear generally rectangular length of cloth, which is usually shipped in a wound form on a spool as a cylindrical-shaped unit, known as a bolt of cloth, which is to be found in textile or department stores, sewing goods stores, country dry-goods stores, and, of course, in factories such as dress or shirt factories. Besides the loss of cloth in cutting and trimming the individual pieces to be assembled into the finished garment in accordance with a pattern, much time is lost in the assembly of the garment since the individual pieces must be properly aligned and then sewn together in the proper order and fashion in order to properly complete the garment.

SUMMARY OF THE INVENTION

1. Purposes of the Invention

It is an object of the present invention to provide an improved garment.

Another object is to provide an improved garment for dressing a person, and especially a woman, over her torso and down her legs, and having a retroverted portion between a person's legs below and spaced from the crotch.

A further object is to provide an improved garment which may be fashioned from a single rectangular length of cloth cut from a bolt of cloth or fabric, without trimming or cutting to conform to a pattern.

An additional object is to provide an improved garment in which no cloth is lost or wasted in fabricating and assembling the garment.

Still another object is to provide an improved garment which may be cheaply, rapidly and easily assembled in mass-production facilities using unskilled labor.

Still a further object is to provide an improved garment which is attractive and comfortable when worn by a person.

These and other objects and advantages of the present invention will become evident from the description which follows.

2. Brief Description of the Invention

The present garment is intended for the dressing of a person who may be either a man, woman or child; in the description infra, for the purposes of simplicity, the person will be referred to as a woman; however, the invention is equally applicable to dressing a child or even a man. The garment may be used as a negligee, daytime outer covering such as a dress, or as a pajama.

The present invention basically entails the provision of a garment, i.e. a dress, for dressing a woman over her torso and down her legs. The garment typically includes and consists of an elongated fabric panel having side edges and end edges. The term fabric will be understood to encompass and include any or all of various types of cloth, e.g. cloth made of cotton, wool, rayon, nylon, linen, silk, etc., as well as other fabric or cloth materials known to the art, which may be felted, woven or knitted.

The panel has a retroverted portion between its opposite end edges. The retroverted portion is adapted to be disposed between a woman's legs below and spaced from her crotch, i.e. the retroverted portion extends between the inner surfaces of the woman's legs. Suitable means is provided for joining at least portions of the side edges spaced from and above the retroverted portion, to leave openings extending upwardly from the retroverted portion at the sides of the garment for the insertion of the woman's legs therethrough, so that the portion of the garment from the waist of the garment down to the retroverted portion has the appearance and functions of a skirt.

The retroverted portion subdivides the panel into a front segment and a rear segment. The upper edge of the front segment, which constitutes an end edge of the panel, is adapted to be disposed in the region of the upper portion of the woman's torso. The upper edge of the rear segment of the panel, which constitutes the other end edge of the panel, is adapted to be disposed on the back of the woman's torso in the region between the waist and the upper portion of the woman.

In a preferred embodiment, the upper edge of the front segment meets the upper edge of the rear segment over the shoulders of the woman, and means is provided for joining the upper edges to each other. In this case, the means for joining the upper edges to each other typically constitutes stitching or a yoke.

In one embodiment of the invention, the rear segment of the panel includes a resilient constrictible waist, e.g. a shirred waist. In this preferred embodiment, typically lengths of linear tape extend from each end of the waist of the rear segment. The opposed lengths of linear tape are of sufficient length so that they may be tied to each other, thereby placing the waist under tension.

In another aspect of the invention, the upper portion of the rear segment of the garment has a tail which is dependent from the upper portion of the rear segment of the garment. Generally, the tail of the upper portion of the rear segment has a length such that the tail may be tucked under the back waistline at the upper edge of the rear segment.

The retroverted portion of the panel may either simply be a folded portion of a single continuous elongated panel, or else the retroverted portion may consist of two edges, together with means securing the edges to each other. In the latter instance, the means securing the edges to each other may be sewing, stitching, stapling, taping, gluing or the like.

The present improved garment provides several salient advantages. The garment is an inproved dress for dressing a woman over her torso and down her legs. The improved garment may be fashioned from a single elongated panel or length composed of cloth or fabric, without trimming or cutting to conform to a pattern. Thus no cloth or fabric is lost or wasted in fabricating and assembling the garment. The present garment may be cheaply, rapidly and easily assembled in mass-production facilities using unskilled labor. The garment is both attractive and comfortable when worn by a woman.

The invention accordingly consists in the features of construction, combinations of elements and arrangements of parts which will be exemplified in the article of manufacture hereinafter described and of which the scope of the application will be indicated in the appended claims.

BRIEF DESCRIPTION OF THE DRAWINGS

In the accompanying drawings in which are shown several of the various possible embodiments of the invention:

FIG. 3 is a sectional elevation view of the garment taken substantially along the line 3—3 of FIG. 2;

FIG. 4 is a sectional plan view of the garment taken substantially along the line 4—4 of FIG. 3; and FIG. 5 is a partial sectional elevation view of the lower portion of an alternative embodiment of the garment.

DETAILED DESCRIPTION OF THE PREFERRED EMBODIMENTS

Figure 2:
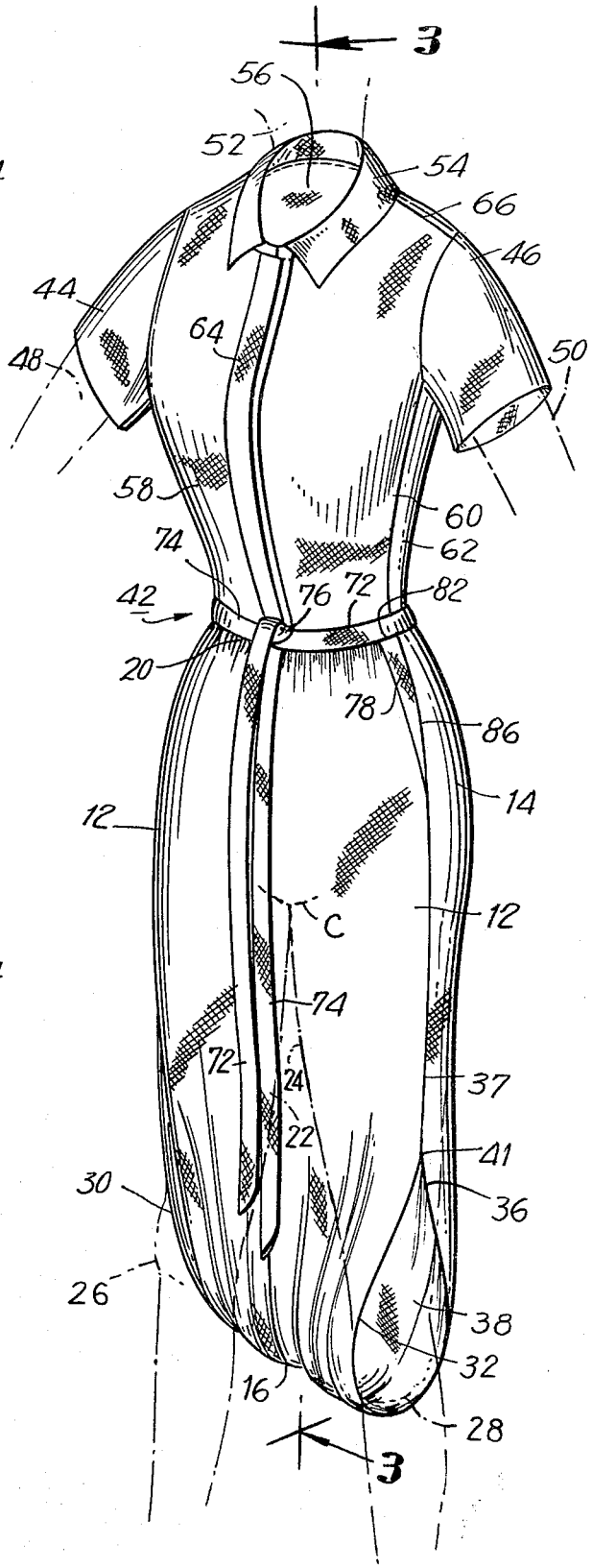
FIG. 2 is a perspective view of the garment as seen from the front.

Referring now to the Figures, the present garment or dress for dressing a woman over her torso and down her legs is basically composed of a single elongated fabric panel 10 having a front segment 12 and a rear segment 14. The panel is subdivided into these segments by a retroverted or folded portion 16 between its opposite end edges 18 and 20. This retroverted portion 16 is adapted to be disposed between a woman's legs below and spaced from her crotch C, as best seen in FIG. 2 where the woman's legs 22 and 24 are shown in phantom outline with respective knees 26 and 28. It will be apparent to those skilled in the art that the retroverted portion 16 could alternatively extend to or below the knees 26 and 28, i.e. to a position juxtaposed with the calves of the legs 22 and 24 rather than with the thighs as shown. In any case, the location of the retroverted portion 16 is spaced from and below the woman's crotch, for purposes of modesty, appearance and comfort.

The panel 10 is of generally rectangular configuration, and is provided with side edges, i.e. side edges 30 and 32 of the front segment 12 and side edges 34 and 36 of the rear segment 14. Suitable means such as stitching or sewing is provided to join at least portions of these side edges; this means 37 and 39 is spaced from and above the retroverted portion 16 as best seen in FIGS. 2 and 3, so as to leave openings 38, 40 extending upwardly from the retroverted portion 16 at the sides of the assembled garment for the insertion of the legs 22 and 24 therethrough, e.g. the lower left side opening 38 accommodates the leg 24 and the lower right side opening 40 accommodates the leg 22. Thus the portion of the garment from the waist 42 of the garment down to the retroverted portion 16 has the appearance and functions of a skirt, as best seen in FIGS. 2 and 3. With specific regard to the means 37, this means 37 terminates at lower point 41, which defines the upper extremity of the opening 38. Thus the means 37 defines the junction between attached or secured portions of the edges 32 and 36 above opening 38. Similar considerations apply to the means 39 which is the secured junction between portions of the edges 30 and 34 above point 43.

The upper edge 20 of the front segment 12, which constitutes an end edge of the panel 10, is adapted to be disposed at the front of the woman's torso, in the region of the waist or upper portion of the woman's torso, and in many instances as seen in FIG. 2, this front edge 20 will be gathered when the garment is in place on the woman's torso. The upper edge 18 of the rear segment 14 of the panel 10, which constitutes the other end edge of the panel 10, is adpated to be disposed at the back of the woman's torso, in the region of the waist 42 or between the waist 42 and the upper portion of the woman.

Figure 1:
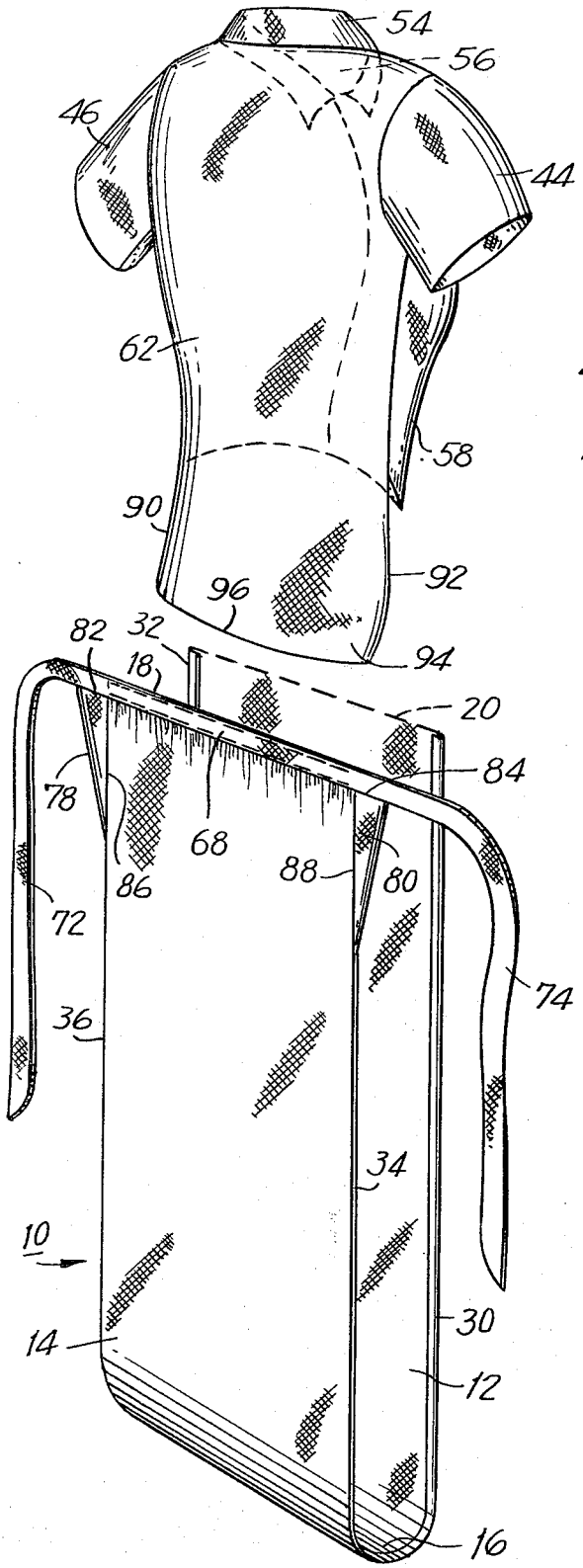
FIG. 1 is an exploded perspective view of the garment as seen from the rear.

Referring now to FIGS. 1 and 2, the upper portion of the garment is of a blouse-like configuration, with respective right and left sleeves 44 and 46, through which the woman's respective right and left arms 48 and 50 extend, as shown in FIG. 2 in partial phantom outline. FIGS. 2 and 3 also show, in phantom outline, a portion of the woman's neck. The neck portion 52 is circumscribed by a collar portion 54 of the garment, which collar portion 54 is folded about a top opening 56 in the garment which accommodates the neck of the woman when the garment is in place.

The upper portion of the garment is constituted by juxtaposed front portions 58 and 60 which cover the chest and bust of the woman, and a rear portion 62 which covers the upper portion of the woman's back. The front portions 58 and 60 are centrally vertically joined at 64 by spaced buttons, a zipper, or other suitable closure. In practice of the invention, when the garment is being fabricated from a suitable textile such as the cloths or fabrics mentioned supra, a single continuous elongated, e.g. rectangular, fabric panel may be provided as a starting element, which single panel may encompass all of the elements 58, 60, 12, 14 and 62 described supra. In this case, the front segment, consisting of elements 58, 60 and 12, will be a continuous unit at the beginning of fabrication of the garment, and the back or rear segment, consisting of elements 14 and 62, will also be a continuous unit as a starting element. Typically in this event, the upper edge of the front segment 58, 60 and 12 will meet the upper edge of the rear segment 14 and 62 over the shoulders of the woman, and means 66 (FIG. 2) consisting of stitching or sewing or the like will be provided for joining the upper edges of the segments to each other. Generally this means will constitute stitching or a yoke.

The rear segment 14 of the panel 10 typically includes a resilient constrictible waist 68 which may be shirred or gathered as shown (FIGS. 1, 2 and 3), and which may include an integral internal rectilinear length of elastic 70 (FIGS. 3 and 4). Generally, when the rear segment 14 of the panel 10 is provided with the resilient constrictible waist 68, respective lengths 72 and 74 of linear flexible tape or straps extend from each end of the waist 68 of the rear segment 14, the opposed lengths 72, 74 of linear belt or tape being sufficiently long so that they may be tied to each other via knot 76, thereby placing the waist under tension by elongating the length of elastic 70, which usually consists of a length of flexible resilient elastic material. Opposed triangular panels 78 and 80 are provided at the respective junctions between the tapes 72 or 74 and the panel segment 14, to provide added strength and also to cover respective lateral vertical splits to be described infra. The top edges 82 and 84 of the respective panels 78 and 80, which consist of cloth, fabric, or any suitable textile material, are secured to the respective tapes 72 or 74 by any suitable means such as stitching i.e. sewing. Similarly, the side edges 86 and 88 of the respective panels 78 and 80 are secured to the respective edges 36 or 34 at the upper end of the segment 14 by stitching or sewing.

The upper rear portion 62 of the garment, which in most instances consists of the upper portion of the rear segment 14, is preferably provided with lower side or lateral free edges 90 and 92 (FIG. 1), so that a tail panel 94 is dependent from the upper portion 62 of the rear segment 14. This tail panel 94 has a lower free edge 96, and generally the tail panel 94 has a length such that the tail 94 may be tucked under the back waistline 68 at the upper edge 18 of the rear segment 14. The reason for the provision of the tail panel 94 separate in most instances from the lower main segment 14, is so that when the woman desires to discharge bodily wastes, the knot 76 can be untied, whereupon the waist of the garment will become slack, and the tail panel 94 may be manually displaced upwards while the upper portion 98 of the rear segment 14, adjacent to the shirred waist 68 and upper edge 18 and shown in FIGS. 3 and 5, may concomitantly be folded outwards and downwards. The phantom outline of upper portion 98 as shown in FIGS. 3 and 5 illustrates this disposition of the upper portion 98 of the rear segment 14.

FIG. 4 shows typical securing means 100 and 102 on opposite sides of the garment for securing the several elements, panels and segments together. These securing means may consist of stitching, sewing, stapling, or the like.

FIG. 5 shows an alternative embodiment of the invention, in which the retroverted portion 104 of the panel 10 consists of two edges 106 and 108, together with means 110, which may consist of sewing i.e. stitching, for securing the edges 106 and 108 to each other.

It thus will be seen that there is provided an article of manufacture consisting of a garment for dressing a woman over her torso and down her legs which achieves the various objects of the invention which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A dress comprising an elongated fabric panel having side edges and end edges, said panel having a retroverted portion between its opposite end edges, said retroverted portion being adapted to be disposed between a person's legs below and spaced from the person's crotch, means joining at least portions of said side edges below the waist spaced from and above said retroverted portion, to leave openings below the waist extending upwardly from said retroverted portion at the sides of the dress for the insertion of the person's legs therethrough, such that the portion of the dress circumscribing the person's waist down to the retroverted portion has the appearance and functions of a skirt, said retroverted portion dividing the panel into a front segment and a rear segment, the upper edge of the front segment which constitutes an end edge of the panel being at the shoulder of the wearer in front of the person's torso, said panel running in one piece from said upper edge to the retroverted portion and then to the rear of the waist of the person, a panel at the back of the dress, the upper edge of the back panel being attached to the upper edge of the elongated fabric panel, the side edges of the back panel being attached to the side edges of the elongated fabric panel down to the waist of the dress, said back panel having a tail adapted to be tucked in the edge of the elongated fabric panel at the rear of the waist of the dress, the elongated fabric panel being shirred at the front of the waist of the dress, the edge of the elongated fabric panel at the rear of the waist of the dress being shirred, lengths of linear tape extending from each side edge of the edge of the elongated fabric panel at the rear waist of the dress, said linear tapes being of sufficient length so that they may be tied to each other at the front of the waist of the dress, and gores at the junctions between the lengths of linear tape and the edges of the elongated fabric panel at the rear waist of the dress, the top edges of said gores being secured to the respective tapes and the vertical edge of each gore being secured to the respective side edges of the elongated fabric panel at the rear of the person so that the gores overlay portions of the elongated fabric panel at the front of the person immediately below the person's waist.

2. The garment of claim 1 in which the rear segment of the panel includes a resilient constrictible waist.

3. The garment of claim 1 in which the elongated fabric panel dresses the person over at least a portion of the persons's torso and down the person's legs.

4. The garment of claim 3 in which the retroverted portion of the panel is disposed between the knees and the crotch of the person.

5. A dress comprising an elongated fabric panel having side edges and end edges, said panel having a retroverted portion between its opposite end edges, said retroverted portion being adapted to be disposed between a person's legs below and spaced from the person's crotch, means joining at least portions of said side edges below the waist spaced from and above said retroverted portion, to leave openings below the waist extending upwardly from said retroverted portion at the sides of the dress for insertion of the person's legs therethrough, such that the portion of the dress circumscribing the person's waist down to the retroverted portion has the appearance and functions of a skirt, said retroverted portion dividing the panel into a front segment and a rear segment, the upper edge of the front segment which constitutes an end edge of the panel being at the shoulder of the wearer in front of the person's torso, said panel running in one piece from said upper edge to the retroverted portion and then to the rear of the waist of the person, a panel at the back of the dress, the upper edge of the back panel being attached to the upper edge of the elongated fabric panel, the side edges of the back panel being attached to the side edges of the elongated fabric panel down to the waist of the dress, said back panel having a tail adapted to be tucked in the edge of the elongated fabric panel at the rear of the waist of the dress, the elongated fabric panel being shirred at the front of the waist of the dress, the edge of the elongated fabric panel at the rear of the waist of the dress being shirred and elasticized, and lengths of linear tape extending fron each side of the edge of the elongated fabric panel at the rear waist of the dress, said linear tapes being of sufficient length so that they may be tied to each other at the front of the waist of the dress.

6. A dress comprising an elongated fabric panel having side edges and end edges, said panel having a retroverted portion between its opposite end edges, said retroverted portion being adapted to be disposed between a person's legs below and spaced from the person's crotch, means joining at least portions of said side edges below the waist spaced from and above said retroverted portion, to leave openings below the waist extending upwardly from said retroverted portion at the sides of the dress for the insertion of the person's legs therethrough, such that the portion of the dress circumscribing the person's waist down to the retroverted portion has the appearance and functions of a skirt, said retroverted portion dividing the panel into a front segment and a rear segment, the upper edge of the front segment which constitutes an end edge of the panel being at the shoulder of the wearer in front of the person's torso, said panel running in one piece from said upper edge to the retroverted portion and then to the rear of the waist of the person, a panel at the back of the dress, the upper edge of the back panel being attached to the upper edge of the elongated fabric panel, the side edges of the back panel being attached to the side edges of the elongated fabric panel down to the waist of the dress, said back panel having a tail adapted to be tucked in the edge of the elongated fabric panel at the rear of the waist of the dress, lengths of linear tape extending from each side edge of the edge of the elongated fabric panel at the rear waist of the dress, said linear tapes being of sufficient length so that they may be tied to each other at the front of the waist of the dress, and gores at the junctions between the lengths of linear tape and the edges of the elongated fabric panel at the rear waist of the dress, the top edges of said gores being secured to the respective tapes and the vertical edge of each gore being secured to the respective side edges of the elongated fabric panel at the rear of the person so that the gores overlay portions of the elongated fabric panel at the front of the person immediately below the person's waist.

* * * * *